United States Patent [19]

Brown

[11] Patent Number: 4,963,031

[45] Date of Patent: Oct. 16, 1990

[54] CEMENT SLURRY BATCHER APPARATUS AND PROCESS

[75] Inventor: Ronald O. Brown, Ottawa, Canada

[73] Assignee: Alsur Enterprises Ltd., Gloucester, Canada

[21] Appl. No.: 380,430

[22] Filed: Jul. 17, 1989

[30] Foreign Application Priority Data

Aug. 9, 1988 [CA] Canada ..... 574245

[51] Int. Cl.[5] ..... B28C 7/04

[52] U.S. Cl. ..... 366/2; 366/8; 366/16; 366/18; 366/40; 366/75; 366/141

[58] Field of Search ..... 366/2, 3, 8, 10, 13–16, 366/18, 30, 34, 40, 67, 75, 138, 141, 152, 162, 179–182, 189, 192; 134/171; 55/256, 385.1, 385.2

[56] References Cited

U.S. PATENT DOCUMENTS

| | | | |
|---|---|---|---|
| 1,546,335 | 7/1925 | Browne . | |
| 1,546,336 | 7/1925 | Browne | 366/34 |
| 2,191,419 | 2/1940 | Bohmer et al. | 366/16 |
| 3,967,815 | 7/1976 | Backus et al. | 366/64 |
| 4,104,736 | 8/1978 | Mendenhall | 366/25 |
| 4,182,617 | 1/1980 | Al-Saidi . | |
| 4,205,919 | 6/1980 | Attwell | 366/34 |
| 4,435,081 | 3/1984 | Del Fabbro | 366/141 |
| 4,459,028 | 7/1984 | Bruder et al. | 366/156 |
| 4,498,783 | 2/1985 | Rudolph | 366/132 |
| 4,588,299 | 5/1986 | Brown et al. | 366/8 |
| 4,589,454 | 5/1986 | Kelley | 366/18 |
| 4,865,457 | 9/1989 | Strehlow | 366/40 |

*Primary Examiner*—Timothy F. Simone
*Attorney, Agent, or Firm*—Trevor C. Klotz

[57] ABSTRACT

A novel process and apparatus for discharging, on a batch basis, cement and water as a slurry or in the form of separate discharges of slurry and cement, where the materials so discharged contain a predetermined amount of water and a predetermined amount of cement, is disclosed. A major quantity of water and all or a major quantity of the cement is mixed in a slurry mixer to produce a primary slurry. A major portion of the primary slurry is then discharged, and the remaining slurry mixed with the remaining quantity of water for discharge as a second slurry. A minor portion of the cement can optionally be added to a dry chamber for discharge therefrom. The slurry mixer and dry chamber, which are substantially closed systems, can be vented together, and then vented to atmosphere, so that air in the slurry mixer which is displaced during water and cement charging flows through the dry chamber. While the normal discharge is from the slurry mixer in slurry form, in situations where the discharge is to be mixed with wet aggregate having a known water content, a minor portion of the predetermined amount of cement required for a concrete mix can be charged in the dry chamber so that it can be separately discharged with the discharge of the slurry from the mixer. The predetermined amount of water and cement for a given batch can be determined by weighing the amount of water and cement separately introduced into the slurry mixer, and in cases where the dry chamber is charged with cement, the weight of cement added to it.

17 Claims, 3 Drawing Sheets

CEMENT SLURRY BATCHER APPARATUS AND PROCESS

This invention relates to a novel process and apparatus useful in batching cement slurry or batching cement and a cement slurry.

In the production of concrete, the pre-mixing of cement and water to form a cement slurry is known. The slurry is then mixed with an aggregate, such as sand or gravel, to produce a concrete mix.

A slurry batcher of the type to which this invention generally relates is disclosed in U.S. Pat. No. 4,588,299 issued May 13, 1986—Ronald O. Brown et al. In this prior art device, predetermined amounts of water and cement are separately charged into a slurry mixer for mixing purposes; the predetermined amount of water and the predetermined amount of cement added to the mixer being controlled by the weight of water and cement added thereto.

In this prior art device, prior to its physical introduction into the mixing chamber, a portion of the predetermined amount of water was retained in a water reservoir; the reservoir serving the twofold purpose of filtering out cement dust carried by air which is displaced from the mixing chamber during cement charging, and afterwards, enabling the reservoir water and collected cement dust to be itself introduced into the mixer, so as to become part of the slurry batch displaying the desired predetermined amounts of water and cement.

The prior art slurry mixer as above described has two major drawbacks. Firstly, and in order to avoid blow-out of reservoir water during cement charging of the mixer, either the cement must be charged into the slurry mixer slowly, or each slurry batch must be produced in small batch amounts. Further, in situations where the aggregate which is to be mixed with the slurry itself contains its own water, in order to accommodate this aggregate water, which must be factored into the desired ratio of cement to water to aggregate, it was found necessary to vary the amount of water used in the slurry mix. In applications where there is an appreciable amount of "make-up" water in the aggregate, a commensurate reduction in the amount of water used in the slurry mix, can result in the production of a thick or pasty slurry and which, if significant, can result in cessation of batching operations due to balling or plugging.

SUMMARY OF THE INVENTION

The above described problems of water reservoir blow-out, low speed mixer charging, small batch production, thick slurry production and aggregate make-up water difficulties as experienced when operating the slurry mixer as disclosed in U.S. Pat. 4,588,299 have been overcome.

In accordance with the apparatus of my invention, it is now possible to discharge, on a batch basis, a predetermined amount of water and a predetermined amount of cement as either a water and cement slurry discharge, or as a water and cement slurry discharge and a cement discharge. In so doing, undesired thick or heavy slurry production can be avoided, make-up water in the aggregate can be readily accommodated, and slow cement charging and water reservoir blow-out concerns obviated.

This can be achieved by utilizing, as before, a substantially closed slurry mixer which includes water inlet means, water reservoir means, means for discharging reservoir water into the mixer, first cement inlet means, water and cement slurry mixing means and slurry discharge means. However, the water reservoir means is not, as was the case in the above described prior art device, utilized as a cement dust filter.

A substantially closed dry chamber is also employed for reasons which will be apparent from that which follows and includes second cement inlet means and cement discharge means. The mixer and dry chamber can each be separately vented to atmosphere in order to exhaust displaced air which results when they are charged together, or, and in the manner I prefer, vented together and then to atmosphere. Accordingly, when cement is charged into the mixer, air which is displaced therefrom is permitted to pass through to the dry chamber via a first vent means and then to atmosphere through a second vent means which advantageously, can also include cement dust filter means. In this configuration, the shock of displaced air issuing from the mixer during cement charging is conveniently and advantageously absorbed to a significant extent by the internal air cavity within the dry chamber. If desired, however, it is possible to vent the displaced air from the mixer through some other shock chamber for cement dust containment purposes, but the existing dry chamber is ideally suited for this purpose. If the dry chamber is itself charged with cement as discussed below, and the mixer and dry chamber are vented together, air displaced from the dry chamber can also be exhausted to atmosphere through the second vent means.

The apparatus of my invention also includes means for determining its weight (which can be a scale which weighs the separate or combined weight of the mixer and dry chamber), as well as means for determining the weight of the water and the weight of cement added thereto (which can be the same scales) so that the predetermined amounts of water and cement required in a particular batch can be controlled by weight measurement. The weighing means can comprise load cells, which are well known in the art, and which either collectively weigh the combined weight of the mixer and drY chamber or the separate weight of these two items, and the weight of water and cement that is to be added to them.

Since the weight of cement and weight of water is a function of the predetermined amounts of each to be added to the apparatus, and hence discharged therefrom, control means, such as any suitable shut-off valves, responsive to these weights is employed to effectively limit the amount of water and cement added thereto, to the predetermined amounts.

In conventional or routine batching operations. only the slurry mixer side of the apparatus is employed and thus the total discharge is in slurry form. However, if the aggregate which itself is to be mixed with the batch slurry discharge itself contains a known amount of make-up water, the water added to the mixer must necessarily be reduced a commensurate amount, and the required amount of cement charged into the apparatus split between the mixer and the dry chamber.

Because a lesser amount of water has been added to the mixer to accommodate the make-up water in the aggregate and similarly, a reduced amount of cement has been added to the mixer, the production of a thick slurry or paste in the mixer is avoided. However, the balance of the predetermined amount of cement for discharge is on hand and is contained in the dry chamber, and thus can be separately discharged therefrom either before, after or concurrently with the discharge of the slurry from the mixer.

The water inlet means, water reservoir means and means for discharging reservoir water which is included in the mixer can either be physically carried on the mixer or separately located from the mixer. The amount of water contained in the reservoir forms a component part of the predetermined amount of water, and since this is determined by weight. I prefer to locate this means on the mixer itself so that its water content can be weighed directly. If the reservoir is located separately from the mixer, the weight of the water contained therein can be measured separately, or if its volumetric size is known, the equivalent weight of water for the reservoir water volume factored into the overall weight of water determination.

Unlike the prior art device described above, the purpose of the reservoir water is to effectively flush out the mixer as a last step in a batching operation. This is achieved by holding the reservoir water in reserve until a primary slurry has been mixed and a major portion of it is discharged. Thereafter, the reservoir water is discharged into the mixer and mixed with the remaining slurry to form a secondary or more dilute slurry, which is then fully discharged from the mixer.

In accordance with the process of my invention, a major quantity of the predetermined amount of water and a first major quantity (which may be the entire amount) of the predetermined amount of cement is added to the slurry mixer to form what has been described as the primary slurry. A major portion of this primary slurry is then discharged. To the remaining quantity of primary slurry in the mixer, the remaining quantity of water in the water reservoir is added to form a diluted or second slurry, which thereafter is also discharged from the mixer.

Advantageously, and as indicated above, the remaining quantity of water used in producing the second slurry, can be carried in the above described water reservoir and included as part of the slurry mixer. Thus, the water reservoir can be filled at the same time the mixer is water charged so that the weight of the water in the reservoir and water in the mixer can be weighed simultaneously.

In situations where make-up water in the aggregate is known and is to be factored into the final ratio of water in the concrete mix, the entirety of the predetermined amount of cement is not introduced into the slurry mixer as the first major quantity, but rather, a remaining quantity of the predetermined amount of cement is introduced into the dry chamber, and thereafter discharged therefrom.

In the process, the predetermined amount of water added to the mixer and the predetermined amount of cement added to the mixer or to the mixer and dry chamber can be measured prior to its introduction. However, and as above indicated, I prefer to control these introduced amounts by determining the weight of cement added to the mixer and to the dry chamber (if such is utilized during a batch operation), and the weight of water added to the mixer.

While the cement in the dry chamber can be discharged at any time, I prefer to discharge it after the discharge of the major portion of the primary slurry and before the discharge of the secondary slurry.

Although the mixer and dry chamber can be separately vented to atmosphere (preferably through dust filters). in practicing the process of my invention, and as indicated above, I prefer to vent the mixer to the dry chamber and then to atmosphere through vent means downstream of the dry chamber. This arrangement only requires one set of dust filter means located on the dry chamber vent to atmosphere and which is capable of filtering out dust whether generated internally of the mixer or the dry chamber. Further, the air space within the dry chamber, because it is in vent communication with the mixer, has the effect of acting as a damping chamber for air which is displaced from the mixer.

Admixtures, as commonly employed in concrete mixes, can be introduced into the slurry mixer through the water inlet or through separate inlet means. Admixtures for air entertainment can be similarly introduced, but for maximum dispersion, I prefer to add these types of admixtures to the water in the water reservoir so that it forms part of the secondary slurry which is more dilute.

Cement which is introduced into the dry chamber for weighing and subsequent discharge, can be discharged direct. However, it is preferred to discharge the dry chamber cement by means of an auger (as is well known in the art) so as to ribbon feed this cement with aggregate material that is being separately fed into a concrete mixing vessel such as commonly found on a concrete mixing truck.

BRIEF DESCRIPTION OF DRAWINGS

In the accompanying drawings which illustrate one working embodiment of my invention.

DETAILED DESCRIPTION OF DRAWINGS

Figure 1:
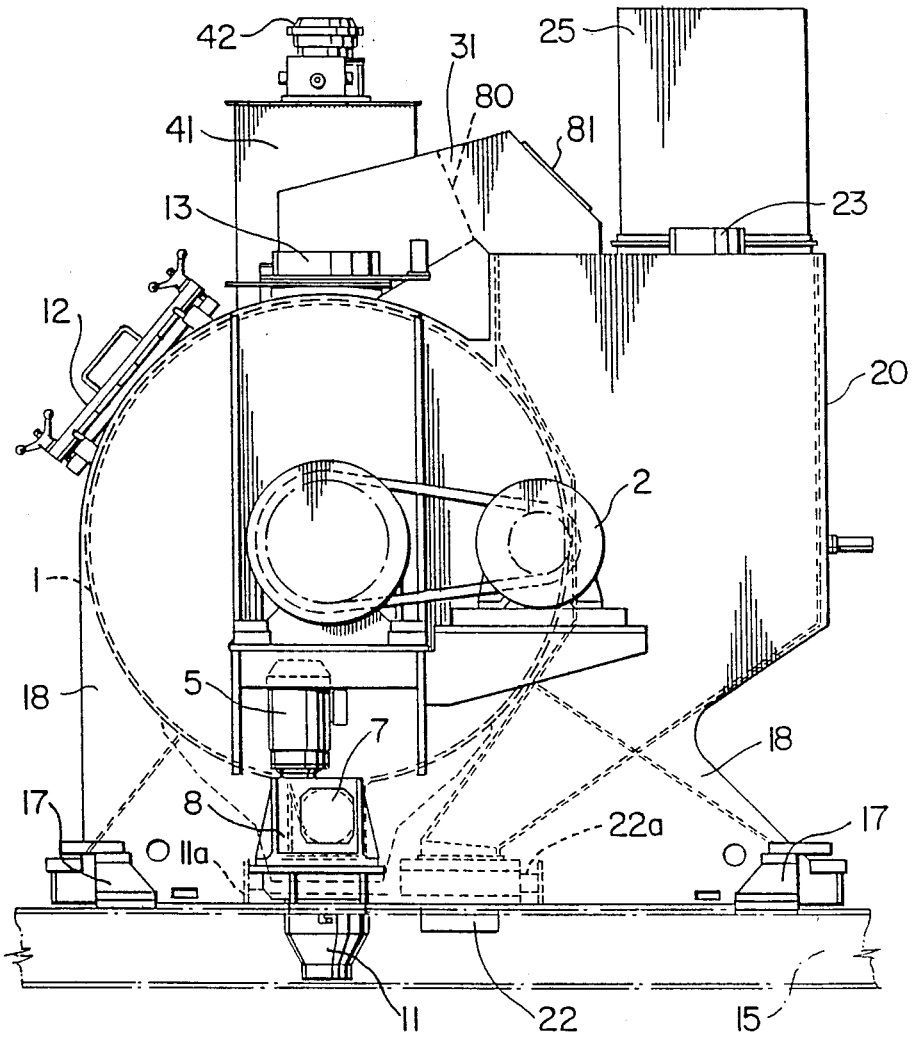
FIG. 1 is an end view of the slurry mixer and dry chamber apparatus mounted on a support beam.

For ease of understanding, and where convenient to do so, the same identifying reference numerals have been used in all of the drawings to indicate like parts.

The slurry mixer 1 internally thereof is provided with mixing blades as well known in the art (not shown) and in this particular application are similar to that as disclosed in U.S. Pat. 4,588,299. The mixing blades are driven by mixer drive motor 2, gear box 3 and drive shaft 4 which carries the aforementioned mixing blades and which extends through either end of mixer 1, as illustrated.

As best seen in FIG. 1, while the mixer 1 is generally circular in cross-section, at its lower end, it is provided with a trough-like section 8 which extends the length of the mixer and which has positioned therealong a reverse-screw auger (not shown) as is also well known in the art. This auger is driven by auger motor 5 that is operatively connected to auger gear box 6 which in turn drives auger shaft 7. The purpose of this reverse auger (not shown) is to convey cement slurry to the central region of the mixer 1 in order to promote the discharge of slurry therefrom through slurry outlet 11 which is opened and closed by means of closure gate 11*a*.

On the upper end of mixer 1 is provided an access door 12 which is employed during maintenance or servicing operations.

Figure 3:
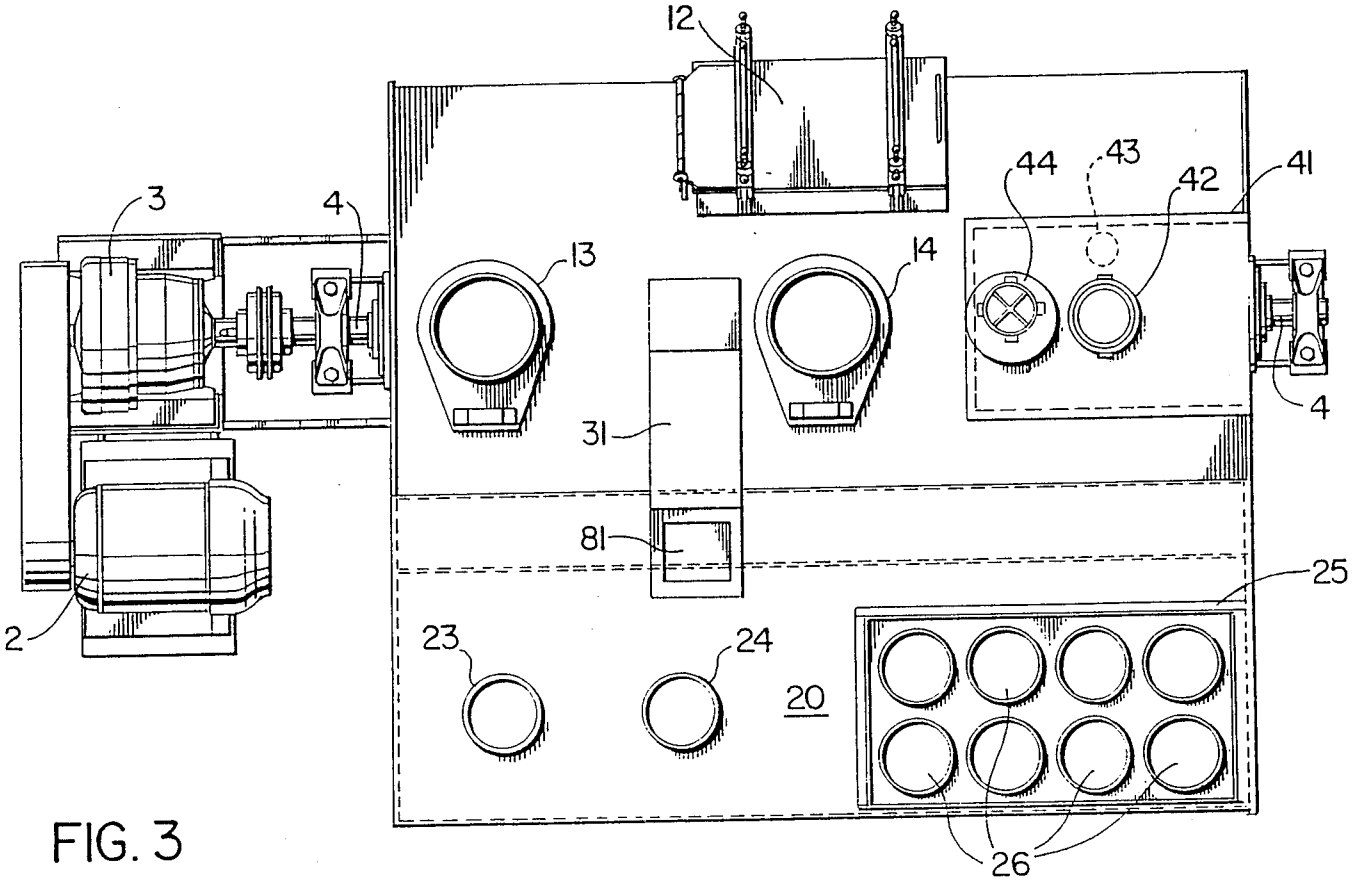
FIG. 3 is a top plan view of the apparatus seen in FIGS. 1 and 2.

Cement is supplied to mixer 1 from a overhead supply, such as a cement hopper (not shown) which communicates with two cement inlets 18 and 14 as best seen in FIG. 3. These inlets can be connected to the hopper by means of a flexible collar (not shown) in order to ensure containment of cement passing therethrough during the charging of the mixer.

Figure 2:
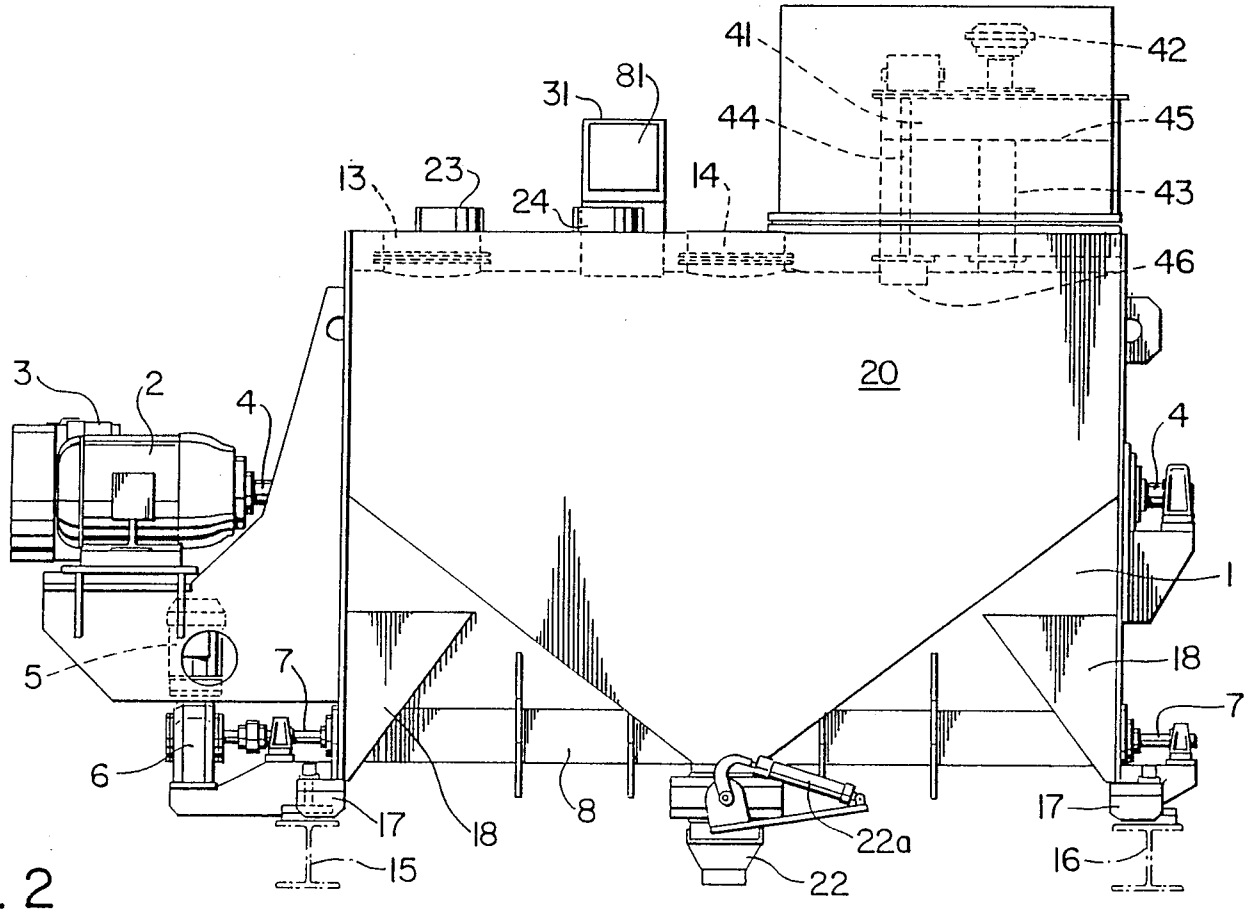
FIG. 2 is a side view of the apparatus as seen from the dry chamber side.

Also located on the top of the mixer 1 is water reservoir 41 as best seen in FIGS. 2 and 3. As shown, water to be introduced into reservoir 41 and mixer 1 is introduced through water inlet 42 and once water level 45 is reached, permitted to flow directly into the mixer through water inlet tube 43. Water which remains in the reservoir 41 at level 45 itself can be discharged into mixer 1 through inlet opening 46 which is opened and closed in response to plunger valve 44.

Dry chamber 20, as illustrated, is attached to slurry mixer and at its lower end is provided with discharge opening 22 which can be opened and closed by means of closure gate **22*a*, which is of a construction well known in the art. Discharge opening 22 is located close to slurry outlet 11 so that separate discharges through these two openings can be fed to the same collector, such as a collector sluice commonly employed when charging a concrete mixer on a concrete mix truck (not shown). Also not shown, but located below discharges 11 and 22, is a source of supply of aggregate; its mixing with the batch discharge as above described being in the same proximity as outlets 11 and 22**.

As mixer 1 and dry chamber 2 in the arrangement as shown are joined together, their common weight (loaded or unloaded) is carried by support legs 18 which in turn are carried by support beams 15 and 16 through the intermediary of load cells generally illustrated at 17. In this particular form of construction, load cells 17 permit the weight of the mixer 1 and dry chamber together with the additional equipment carried thereon such as the water reservoir 41 and motors 2 and 5 to be weighed in unloaded form. The addition of water which is added to the mixer, and the addition of cement which can either be added to the mixer alone or in part to the dry chamber 20, can also be separately measured.

As illustrated, the dry chamber 20 also is provided with cement inlet means such as separate cement inlets 23 and 24, which are connected to a cement supply hopper (not shown) using interconnecting collars (not shown) as previously discussed in connection with supply inlets 13 and 14 located in the upper surface of mixer 1.

During charging with cement and to a lesser extent when charging with water, displaced air within the mixing chamber and air which is displaced in the dry chamber 20 can be separately vented to atmosphere. As illustrated, however, I prefer to vent displaced air from mixer 1 to chamber 20 through connecting vent 31, and then to atmosphere through filter box 25 located on the top of chamber 20 and which, on the upper surface of the box, includes a number of cement dust filters 26 as best seen in FIG. 3. In this form of construction, because there is only one vent to atmosphere, only one common set of cement dust filters is necessary.

In order to restrict moisture or humidity flow from the mixer to dry chamber, I employ a rubber flap 80 internally of vent 31 and which is accessable through clean out port 81 as best seen in FIG. 1.

In a batching operation, and when starting with an empty mixer 1 and empty chamber 20, water is permitted to enter reservoir 41 through inlet 42 in order to fill it up to level 45 and thereafter, to pass through overflow pipe 43 so as to enter directly into the interior of mixer 1. Utilizing suitable control means, such as a tap, solenoid switch or the like (not shown), the water supply can be shut off once a predetermined amount of water has entered or is otherwise carried by mixer 1, including the water in reservoir 41, and which is based on the weight of the water added to the mixer as determined by load cells 17.

In a similar manner, and in a situation where only the mixer and not the dry chamber is to be charged with cement, cement is introduced into the mixer through inlets 13 and 14, and the supply of cement thereto is shut off in a conventional and known manner when the weight of added cement, in addition to the weight of the water already weighed, achieves a predetermined weight as measured by load cells 17.

But for the water contained in water reservoir 41, the water and the cement as added to mixer 1 is mixed together to form a primary slurry in a known manner. A major portion of this primary slurry is then discharged through outlet 11 employing closure gate **11*a* for this purpose. When gate 11*a* is closed, plunger 44 is opened, and the water contained in the reservoir is discharged therefrom through opening 46 and permitted to mix and thus dilute the remaining slurry within the mixer 1**. This diluted or secondary slurry, when undergoing mixing, also assists in flushing the mixer of residual unmixed cement, preparatory to the next mixer batcher operation. The secondary slurry is then discharged from the mixer in the same manner as the major portion of the primary slurry was discharged.

In situations where the predetermined amount of aggregate contains a known quantity of make-up water, or in other cases where it is not desired to effect total discharge of water and cement in cement slurry form, the predetermined amount of cement to be batched can be split between the mixer 1 and dry chamber 20 by permitting cement to enter inlets 13 and 14 on the mixer and to enter through inlets 23 and 24 on the dry chamber. In practice, when the apparatus is operated in this manner, the major quantity of the predetermined amount of cement is added to the mixer 1, and a lesser amount to the chamber 20: but the combined weight of two is determined by the weight of cement added to both; again using weight measuring load cells 17 for this purpose. By actuating closure gate 22a, the cement contained within chamber 21 can be separately or concurrently discharged from chamber 20 with the discharge of the primary or secondary slurry which passes through discharge outlet 11.

It will be apparent that the weight of the mixer and the weight of the dry chamber can be separately weighed in either their charged or empty condition, or their combined weights when charged or empty can be measured to determine the amount of water or cement added thereto as previously described. As indicated above, the weight of the water in the reservoir water need not be measured if it is located elsewhere than on the mixer, provided its volume is constant and its weight equivalency is factored with the weight of the water which enters the mixer direct when making up the primary slurry.

I claim:

1. A process for discharging, on a batch basis, a predetermined amount of water and a predetermined amount of cement as either a water and cement slurry discharge or as a water and cement discharge and a cement discharge, comprising:

(a) adding a major quantity of said water and a first major quantity of said cement to a slurry mixer to form a primary slurry, and discharging a major portion of said primary slurry from said mixer;

(b) adding the remaining quantity of said water to the remaining quantity of said primary slurry in said mixer to form a secondary slurry, and discharging said secondary slurry from said mixer;

(c) optionally adding any remaining quantity of said cement to a dry chamber, and discharging said remaining quantity of said cement from said dry chamber; and (d) venting air displaced in said mixer during the addition of step (a) to atmosphere and venting air displaced in said dry chamber during the addition of step (c) to atmosphere.

2. The process as claimed in claim 1, wherein the air displaced in said mixer is vented to atmosphere through said dry chamber.

3. The process as claimed in claim 1, wherein said first major quantity of cement is said predetermined amount of said cement.

4. The process as claimed in claim 1, 2 or 3, wherein said predetermined amount of water and said predetermined amount of cement is separately determined by measuring the weight of water and the weight of cement added to said mixer.

5. The process as claimed in claim 1, 2 or 3, wherein said remaining quantity of said cement is added to said dry chamber, said predetermined amount of cement is determined by measuring the weight of cement in said mixer and the weight of cement in said dry chamber, and said predetermined amount of water is determined by measuring the weight of said major quantity of said water and the weight of said remaining quantity of said water.

6. The process as claimed in claim 1, 2 or 3, wherein said remaining quantity of cement is discharged prior to the discharge of said secondary slurry.

7. The process as claimed in claim 1, 2 or 3, wherein said remaining quantity of cement is discharged after the discharge of said secondary slurry.

8. The process as claimed in claim 1, 2 or 3, wherein the displaced air vented to atmosphere passes through cement dust filter means.

9. The process as claimed in claim 1, 2 or 3, wherein the batch discharge is mixed with a predetermined amount of aggregate having a known water content to form a concrete mix.

10. A slurry mixer and dry chamber apparatus for discharging, on a batch basis, a predetermined amount of water and a predetermined amount of cement as either a water and cement slurry discharge or as a water and cement slurry discharge and a cement discharge, comprising:

(a) a substantially closed slurry mixer which includes water inlet means, first cement inlet means, water and cement slurry mixing means, slurry discharge means and means for venting said mixer to atmosphere;

(b) water reservoir means and means for discharging water in said water reservoir into said mixer;

(c) a substantially closed dry chamber which includes second cement inlet means, cement discharge means, and means for venting said dry chamber to atmosphere; and (d) means for determining the weight of said water and the weight of said cement added to said apparatus and for use in limiting the weight of water and the weight of cement added to the apparatus to said predetermined amounts.

11. The apparatus as claimed in claim 10, wherein said mixer vent means is vented into said dry chamber and said dry chamber vent means is vented to atmosphere through dust filter means.

12. The apparatus as claimed in claim 10 or 11, wherein said weight determining means includes means for determining the weight of said mixer when in its unloaded and loaded condition and means for determining the weight of said dry chamber when in its unloaded and loaded condition.

13. The apparatus as claimed in claim 10 or 11, wherein said predetermined amounts are discharged as a slurry from said mixer.

14. The apparatus as claimed in claim 10 or 11, wherein said predetermined amounts are discharged as a slurry from said mixer and as cement from said dry chamber.

15. The apparatus as claimed in claim 10 or 11, wherein a major portion of said water is introduced into said mixer through an overflow inlet in said water reservoir and the remaining water is introduced into said mixer through said water reservoir discharge means.

16. The apparatus as claimed in claim 10 or 11, wherein a major quantity of said cement is introduced into said mixer through said first cement inlet means and a remaining quantity of said cement is introduced into said dry chamber through said second cement inlet means.

17. The apparatus as claimed in claim 10 or 11, wherein said water reservoir means and said means for discharging reservoir water into said mixer are located on said mixer.

* * * * *